United States Patent [19]

Edmonson

[11] 4,407,133

[45] Oct. 4, 1983

[54] SELF-CONTAINED PORTABLE TEMPERATURE-CONTROLLED CHAMBER FOR MEDICATIONS AND THE LIKE

[76] Inventor: Glenn V. Edmonson, 1434 Roxbury Rd., Ann Arbor, Mich. 48104

[21] Appl. No.: 291,794

[22] Filed: Aug. 10, 1981

[51] Int. Cl.[3] ..... F25B 21/02; F25D 3/08

[52] U.S. Cl. ..... 62/3; 62/457

[58] Field of Search ..... 62/3, 457

[56] References Cited

U.S. PATENT DOCUMENTS

| | | | |
|---|---|---|---|
| 3,211,214 | 10/1965 | Chambers | 62/3 X |
| 3,438,214 | 4/1969 | Schmittle | 62/3 |
| 3,973,938 | 8/1976 | Szabo et al. | 62/3 |
| 4,006,606 | 2/1977 | Underdue | 62/457 X |

*Primary Examiner*—Lloyd L. King

*Attorney, Agent, or Firm*—Price, Heneveld, Huizenga & Cooper

[57] ABSTRACT

A temperature-controlled chamber comprises a portable, insulated housing with an internal cavity shaped to receive a container of temperature-sensitive material therein, such as insulin, antibiotics, or the like. A thermoelectric element, or heat pump, has one face in heat-transfer relation with the housing cavity, and the other face connected with a heat exchanger having an exterior portion exposed to the atmosphere. A source of electric power is coupled to the thermoelectric element through a thermostat control which energizes the thermoelectric element in response to temperature fluctuations in the housing cavity. The thermostat control includes switching means to reverse the polarity of the power supplied to the thermoelectric element as a function of whether the sensed temperature in the housing cavity is too high or too low, to alternatively heat or cool the housing cavity as required to maintain the cavity at a generally constant temperature.

13 Claims, 5 Drawing Figures

SELF-CONTAINED PORTABLE TEMPERATURE-CONTROLLED CHAMBER FOR MEDICATIONS AND THE LIKE

BACKGROUND OF THE INVENTION

The present invention relates to temperature-controlled chambers, and in particular to a portable storage module, preferably of markedly small size, for temperature-sensitive materials, such as insulin, and other water-based medications.

Many medications which are prescribed to be taken on a daily basis must be kept in a controlled-temperature environment. Such medications include insulin, antibiotics reconstructed in sterile water, allergy and other serums, vaccines, suppositories, snake anti-venom, and many others. If the temperature of such substances is not carefully controlled, they lose their stability and potency, and may in fact present health hazards.

Heretofore, refrigerated containers have been available for preserving insulin and other similar medications during travel. However, most such devices have in the past merely been passive insulated carriers, while other more recent active devices are capable of only cooling the medication. Because these medications deteriorate not only when exposed to high temperatures, but also to overly low temperatures, particualarly below freezing, the portable refrigerator-type devices are not effective for all types of year-round travel. For instance, if a temperature-sensitive medication like insulin were exposed to freezing temperatures for any extended period of time, such as those experienced in the baggage compartments of airplanes on transcontinental flights, or in automobiles, campers, or other recreational vehicles during the winter months in the northern regions of the country, the insulin would be ruined. It is quite expensive to purchase a new supply of medication, and even more importantly, it can be difficult or even impossible to replace the medication in a foreign or remote location. Travelers can expect to encounter substantial difficulty and delay, not to mention expense, in obtaining replacement medication. As a result, patients who are required to take medications often or regularly experience serious anxiety when traveling, particularly among the elderly and infirm, often to the extent which renders long trips totally impracticable.

Another problem experienced with refrigerator traveling kits is that they are either overly large and cumbersome, or else the size of the medication receptable is fixed such that it can receive only a certain size of vial. As a result, the user is not always able to carry an appropriate amount of medication with him, thereby causing either wastage, or requiring the user to replenish his supply sometime during his absence from home.

SUMMARY OF THE INVENTION

A major aspect of the present invention is to provide a temperature-controlled chamber comprising an insulated housing having a cavity particularly shaped to receive a receptacle of medication or other temperature-sensitive material therein, and to provide a novel and highly desirable self-contained thermal compensation system which will maintain a desired temperature range regardless of whether ambient conditions are too hot or too cold. In furtherance of this aspect, a thermoelectric element is mounted in the housing with one face in heat-transfer relation with the housing cavity, to transfer heat therebetween. A heat exchanger is connected with the housing, and includes a first portion in heat-transfer relationship with the other face of the thermoelectric element, as well as a second portion communicating with the ambient atmosphere to exchange heat therewith. A source of electric power is connected with the thermoelectric element, and a switch mechanism is provided to apply either forward or reverse polarity electrical power to the electric power which energizes the thermoelectric element in response to temperature fluctuations in the housing cavity, whereby the thermoelectric element can either heat or cool the housing cavity, so as to maintain the material inside at a substantially constant, preselected temperature. For this purpose, a thermostat is preferably provided to automatically energize the thermoelectric element in response to temperature fluctuations, in the housing cavity, and to control the polarity of the electric power applied to the thermoelectric element as necessary to maintain the preselected temperature by either cooling or heating.

Another aspect of the present invention is to provide a temperature-controlled chamber having a desirable two-piece housing configuration, with first and second housing portions which sealingly adjoin one another, and a removable clip for detachably holding the two such housing portions assembled together. The upper housing portion has the thermoelectric element, the heat exchanger, the electric power source, and a polarity-reversing switch mounted wholly therein. The lower housing portion has a cavity in which the vial or other receptacle of temperature-sensitive media is received. An alternate lower housing portion is provided, and includes a cavity shaped to receive a different size of receptacle. The alternate lower housing portion is adapted for readily-detachable connection with the upper housing portion to thereby provide an inexpensive arrangement for changing the effective size of the receptacle whose temperature is to be regulated.

The principal objects of the present invention are to provide a portable, temperature-controlled chamber for temperature-sensitive materials, such as medications like insulin and the like, having means for either heating or cooling the medium to retain the medication at a substantially constant, preselected temperature or temperature range. The heating/cooling mechanism is a thermoelectric element, or heat pump, which is preferably controlled by a thermostat having a switch which automtically reverses the polarity of the power applied to the heat pump in response to corresponding temperature fluctuations. The chamber has a two-piece housing with the operating elements located in one portion, and the vial-receiving cavity in the other portion, such that an alternate vial-carrying portion can be attached to the operating housing to effectively change the size of the receptacles holding the medication. The chamber includes a heat-exchanger connected with the operative housing portion to transfer heat with the atmosphere, functioning as a radiator in the cooling mode and as an absorber in the heating mode. A temperature-sensor and switching circuit automatically interrupt power distribution to the thermoelectric element in the event that the temperature of the heat exchanger exceeds a predetermined level, so as to prevent damage to the thermoelectric unit. The housing includes a chamber for storing batteries to power the thermoelectric unit, as well as a receptacle and switch for powering the unit with other available sources of electrical power.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
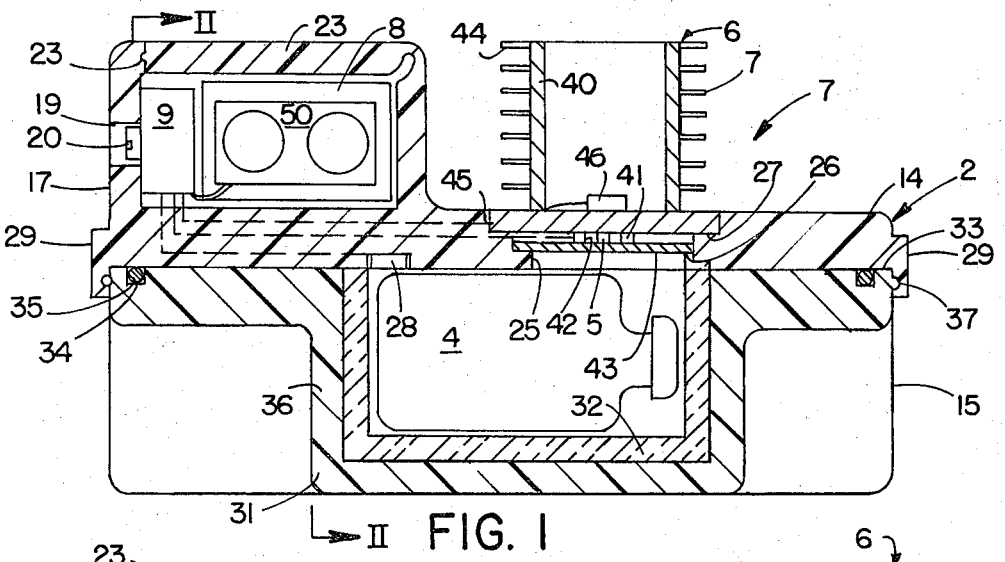
FIG. 1 is a cross-sectional elevational view of a temperature-controlled chamber embodying the present invention, with a vial of medication shown positioned therein.

For purposes of description herein, the terms "upper", "lower", "right", "left", "rear", "front", "vertical", "horizontal", and derivatives or variations thereof, shall be understood as relating to the invention as oriented in FIG. 1. However, it is to be understood that in use the invention may assume various alternative orientations, except where or to the extent expressly specified to the contrary.

The reference numeral 1 (FIG. 1) generally designates a temperature-controlled chamber apparatus in accordance with the invention, comprising a portable, insulated housing 2 having an internal cavity 3 shaped to receive a vial or other container 4 of temperature-sensitive material therein, such as insulin, antibiotics, and other types of water-based medications. A thermoelectric element or heat pump 5 has one face in heat-transfer relationship with housing cavity 3, and another face in heat-transfer relationship with a heat exchanger 6, having an exterior finned portion 7 exposed to the atmosphere. A source of electrical power, such as internally mounted batteries 8, is connected with heat pump 5, and a thermostat 9 controls the electrical energization of the heat pump 5 in response to temperature fluctuations sensed within housing cavity 3. Thermostat 9 is of the compound, or heating/cooling type, which includes dual electrical switching means that in this application are used to switch opposite (reverse) polarity electrical excitation to heat pump 5, whereby the heat pump can either heat or cool housing cavity 3 to maintain vial 4 and its contents at a substantially constant, preselected temperature.

Figure 2:
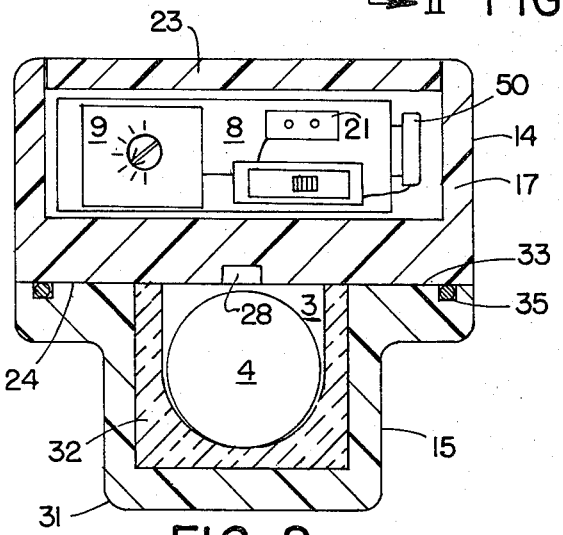
FIG. 2 is a further cross-sectional elevation of the chamber shown in FIG. 1, taken along the section line II—II thereof.
Figure 3:
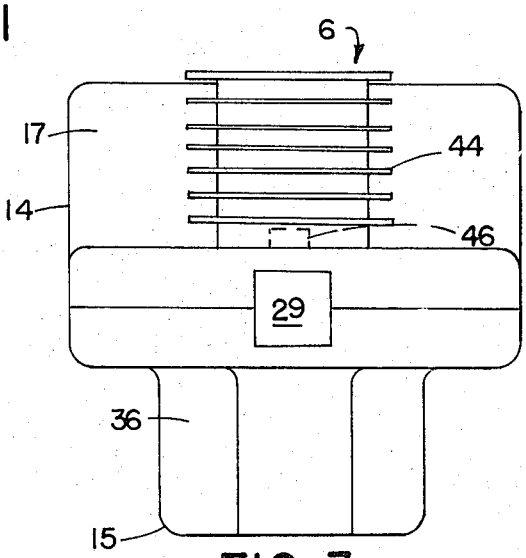
FIG. 3 is an end elevational view of the chamber as seen from the right side thereof as oriented in FIG. 1.

Housing 2 is preferably a small, readily-portable, hand-held device which can be easily transported. Housing 2 preferably has a two-piece construction, with upper and lower members 14 and 15 which sealingly abut, or adjoin, and are detachably interconnected to form a closed chamber. In the illustrated structure, the upper housing portion 14 includes a substantially flat planar portion 16 with an integral hollow casing 17 at its left-hand side as viewed in FIG. 1. Upper housing portion 14 is preferably constructed from a rigid, molded polymer such as a polyphenol compound. Thermostat 9 is mounted in the end wall 18 of the hollow casing 17, and a laterally-extending aperture 19 is provided in end wall 18 for affording acess to an adjustment screw 20 of the thermostat, as described in greater detail hereinafter. Casing 17 also includes an electrical receptacle or socket 21 (FIG. 2), and a switch 22, also described in greater detail hereinafter. An integrally-formed, hinged top hatch or closure 23 (FIG. 1) with a snap lock 23' at the free edge is provided to access the interior of casing 17, for replacing batteries, or otherwise servicing the unit.

The lower surface or base 24 of the top housing portion 14 is substantially flat and rectangular in shape, with an aperture 25 (FIG. 1) extending upwardly through a medial portion thereof. Aperture 25 includes annular steps or shoulders 26 and 27 which facilitate mounting the heat pump 5 and heat exchanger 6 therein, as described hereinafter. A temperature sensor 28 is mounted in the base of the upper housing portion 14, at a position disposed adjacent the left-hand end of housing cavity 3 when the upper and lower housing halves are interconnected. Temperature sensor 28 is electrically connected with thermostat 9 to cooperate therewith in automatically regulating the temperature within housing cavity 3. Snap-lock clips 29 (FIGS. 1 and 4) depend from each end of the upper housing part 16, and are shaped to securely yet detachably interconnect the upper and lower portions 14 and 15 of housing 2. In the form illustrated, the clips 29 are integrally molded with the upper housing 14, in the form of depending tongues, which are stiffly flexible outwardly to release the lower housing 15 when desired, but normally holding the latter securely in place.

The lower portion 15 of housing 2 is internally insulated, and includes a rigid, puncture-proof outer shell 31 constructed of molded polymeric "plastic" such as a phenol compound, or the like, and an insulative liner 32 of polyurethane or other comparable insulating material. Lower housing portion 15 has a flat upper surface or face 33 which is shaped to abuttingly mate with the lower surface 24 of upper housing portion 14. A channel 34 extends around the marginal edge of upper surface 33 adjacent the outer edge thereof, and is shaped to receive an O-ring seal 35 therein. The cavity 3 is positioned in the medial portion of lower housing 15, and extends longitudinally from the right-hand edge of aperture 25 to the left-hand edge of temperature sensor 28, to communicate with both. In this example, housing cavity 3 has a U-shaped transverse cross-sectional shape, adapted to receive a cylindrically-shaped vial 4 therein. The base portion 36 of lower housing 15 is shaped in accordance with the internal cavity 3, which in this example is U-shaped. However, it is to be understood that the shape of housing cavity 3 and base 36 can be modified to accommodate virtually any particularly-shaped vial therein. Preferably, the shape of the top face 33 of lower housing 15 is designed to mate with the bottom face 24 of the upper housing 16, which in the illustrated example is rectangular. A protuberance or ledge 37 is preferably provided at each end of the lower housing portion 15, in registry with the aforementioned housing clips 29, which matingly receive the ledges in complementary recesses, and thereby form a snap lock.

Thermoelectric element 5 (FIG. 1) is a commercially-available miniature heat pump of conventional construction, which includes opposing faces 41 and 42 between which heat is transferred when the unit is electrically energized. Heat pump 5 is connected electrically with the selected power source through thermostat 9, and preferably is designed to be powered by a 12-volt DC source of electricity. However, it is to be understood that any suitably-sized heat pump with an appropriate source of electrical power is within the general contemplation of the present invention. In this example, heat pump 5 is fixedly attached to a disc-shaped, conductive diaphragm 43 by integral means such as fusing. Diaphragm 43 increases the effective surface area of the lower heat pump face 42 to improve heat transfer between the heat pump and the housing cavity 3. Heat pump 5 is preferably of the Peltier type, and will, in the present application, require approximately four watts of power.

Heat exchanger 6 is in heat-transferable relationship, or communication, with the upper face 41 of heat pump 5, and acts as a radiator when the heat pump is drawing heat from the chamber to cool the same, and as a heat absorber when the heat pump is used to heat the housing cavity. In this example, heat exchanger 6 comprises a cylindrically-shaped core 40 having a plurality of annular radiating fins 44, and an integrally-formed, disc-shaped base 45 in the nature of a heat sink which is mounted in recess 27 of housing aperture 25. Heat exchanger 6 is constructed from a highly conductive material, such as cast aluminum, and can be molded integrally into the upper housing portion 14. The lower surface of heat sink 45 is in abutting contact with the upper face 41 of heat pump 5, to facilitate transfer of heat therebetween by conduction. Diaphragm 43, which is in the nature of a leaf spring, resiliently retains heat sink 45 and heat pump 5 in abutment, for improved heat transfer. A second temperature-sensor 46 is mounted on the upper surface of heat sink 45, within the interior of heat exchanger 6, and is electrically connected with thermostat 9. Temperature sensor 46 is adapted to detect overheating in heat pump 5, and to automatically interrupt power to the heat pump under overheated conditions until the heat pump has cooled. An audible alarm (not shown) may be connected with the overheat circuit of sensor 46, to advise the user that power has been interrupted. Both temperature sensors 28 and 46 are preferably in the nature of thermocouples, which produce a voltage differential in response to temperature fluctuations.

The temperature-controlled chamber 1 is preferably provided with means for powering the unit from any one of a variety of different types of electrical sources, according to that which is most convenient and economical under the circumstances. In the example shown, batteries 8 are mounted internally in the unit, and a snap-type cap or connector 50 electrically connects the batteries with thermostat 9 through switch 22. A battery test lamp 51 may be provided, connected with the battery circuit through a "push-to-test" switch 51*a*, to permit the user to quickly and easily determine if the batteries are operative, in the same general manner as is frequently done in cameras and other battery-equipped devices. In this manner, the temperature-controlled unit is made completely portable when the user does not have access to any external source of electrical power. The unit also preferably includes electrical receptacles (i.e., sockets) 21 and 21*a*, which are adapted to receive a mating plug, connectable with an external power source, such as form an automobile cigarette lighter socket or converted household current (receptacle 21*a*) or from standard AC household power (receptacle 21), so as to prolong the life of batteries 8 by avoiding unnecessary usage thereof. Of course, it is entirely feasible to build into the unit a miniaturized electrical rectifier such as a diode bridge or the like, which may include a step down transformer or other voltage divider network, to internally convert applied household AC power and/or provide for recharging of the internal batteries 50.

Thermostat 9 includes electrical switching components and circuitry (not shown) of conventional design, which automatically makes and breaks an electrical connection between the source of electrical power and heat pump 5 in response to temperature differences existing between that sensed by sensor 28 and the temperature selected by the user and set by use of thermostat 9. In this manner, the temperature of the air in housing cavity 3 is automatically regulated to maintain the temperature of the serum in vial 4 at a substantially constant, preselected temperature. The temperature setting of thermostat 9 is adjusted by rotation of set screw 20, and preferably indicia 52 (FIG. 5) is provided to facilitate adjustment and setting. Thermostat 9 also includes a circuit, of conventional design, which reverses the polarity of the power supplied to thermoelectric element 5 when the temperature sensed by sensor 28 falls below a level corresponding to that at which the thermostat is set.

Figure 4:
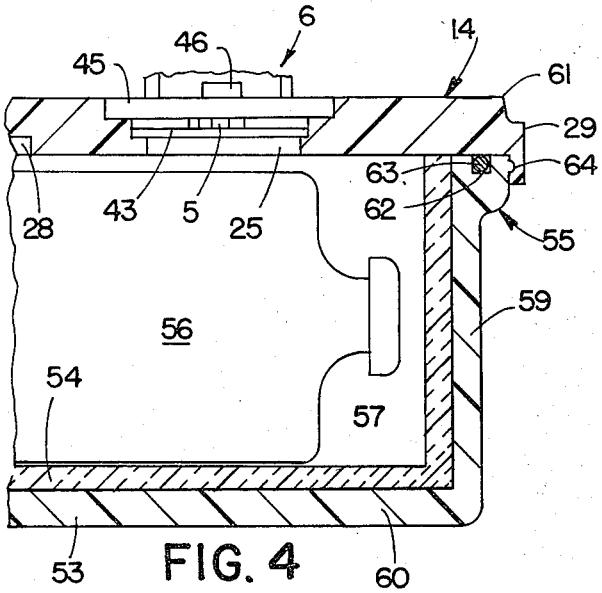
FIG. 4 is a fragmentary, vertical cross-sectional view of another embodiment of the present invention, having an alternate housing base for larger medication vials.
Figure 5:
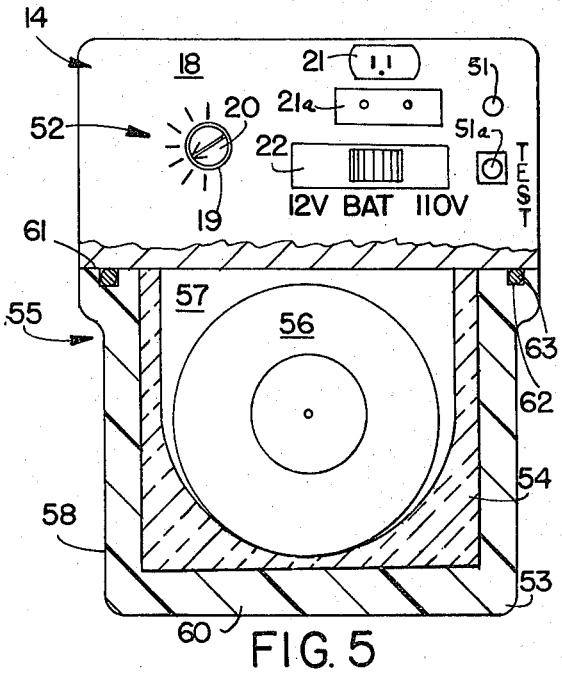
FIG. 5 is a fragmentary, end elevational view of the chamber shown in FIG. 4, with a lower portion thereof broken away to reveal internal construction.

As best illustrated in FIGS. 4 and 5, the temperature-controlled unit 1 also includes one or more alternative housing lower units, or portions, 55, which are shaped to receive different sizes of receptacles or medication vials 56 therein. Like previously-described housing portions 15, housing portions 55 are preferably insulated, and have a rigid shell 55 and an insulative liner 54. In this example, vial 56 is larger than vial 4 of FIGS. 1 and 2, such that the corresponding cavity 57 for vial 56 is correspondingly larger in size to wholly receive the vial therein. The illustrated cavity 57 is U-shaped, to accommodate the cylindrical shape of vial 56, and the housing lower unit 55 is generally rectangular in shape, with side and end walls 58 and 59, respectively, and a base 60. The upper ends of the walls 58 and 59 form a face 61 which is substantially identical with the shape of face 24, such that the top of lower unit 55 mates with the lower surface of housing upper portion 15, and is securely and detachably connected therewith by clips 29. The upper face 61 includes a marginal channel 62 in which an O-ring seal 63 is positioned to abuttingly seal against the upper housing face 42. In this manner, the user can adapt the present device for variously-sized vials or containers, by simply using an approximately-sized housing base, or lower portion. The ends of the alternate housing bases 55 include lips 64, which are substantially identical to previously-discussed lips 37, so as to mate with clips 29 and thereby snap lock the upper and lower housing parts together. Since the temperature-controlling members of the unit, such as heat pump 5, heat exchanger 6, power source 8, and thermostat 9, are all mounted in the housing upper portion 14, the alternate lower housing portions are relatively inexpensive, and are easily attached to the upper half.

In use, a housing lower portion, such as 15 or 55, is selected in accordance with the size of the medication vial to be used. The vial is then inserted into the lower housing cavity 3, and is fully received therein, such that the vial does not protrude from the open end of the cavity. The selected housing lower part 15 with medication vial therein is then attached to the upper part 14 of the device, by use of the snap locks 29 at the ends of the unit. O-ring 35 abuts the mating surface of upper housing portion 14, and forms a seal about the marginal edge of the adjacent faces, to alleviate heat transfer to or from the interior of the housing from outside. The user then adjusts screw 26 of thermostat 9 in accordance with the temperature at which the medication must be maintained. The type of electrical power which will be used to energize the unit is selected, and selector switch 22 is manipulated accordingly.

During the operation of the unit, temperature sensor 28 detects the temperature within housing cavity 3, and when this temperature rises above that preselected in thermostat 9, an internal switch makes the circuit between the electrical power source and heat pump 5, with the plurality oriented so as to pull heat from cavity 3 and thus cool the same. Since the chamber 1 is normally in the upright position shown in the drawings, the air cooled by diaphragm 42 tends to fall into the insulated lower housing, around the vial, thereby circulating the warmer air toward the diaphragm for cooling. The heat from cavity 3 is in turn transmitted from the hot face 41 of heat pump 5 to heat sink 45, and to heat exchanger 6, where it is ultimately dissipated into the ambient atmosphere through cylindrical core 40 and fins 44. If the temperature of heat sink 45 exceeds that level which would cause damage to heat pump 5, temperature sensor 46 will transmit a signal to thermostat 9, and interrupt power to the heat pump 5 until such time as it has cooled to a safe operating temperature.

If the temperature of housing cavity 3 falls below the preselected temperature set in thermostat 9, a separate "low limit" switch or contact in the thermostat automatically actuates, to cause a reversal of the polarity of the electrical power supplied to heat pump 5, thereby causing heat in the atmosphere to be absorbed by heat exchanger 6, and emitted from the lower face 42 of the heat pump into housing cavity 3, to raise the temperature. The fins 44 and cylindrical core 40 of heat exchanger 6 increase effective surface area, and thus improve heat absorption and radiation. Diaphragm 43 increases heat transfer efficiency both to and from housing cavity 3.

The ability of the present device to automatically heat or cool the interior of housing cavity 3 enables the user to preserve medication in both very cold and very hot climates. Thermostat 9 also enables the user to initially set the temperature at which the medication is to be maintained, and the unit operates automatically thereafter in response to this set point. The two-piece construction of the housing 2 permits the use of interchangeable different-capacity lower portions for variously-sized medication vials.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A personal, self-contained, manually portable temperature-controlled chamber for medications and the like, comprising:

an insulated housing having a cavity shaped to receive a receptacle of temperature-sensitive material therein;

a thermoelectric element mounted in said housing, and having first and second heat-transfer faces; one of said faces being in heat-transfer relation with said housing cavity, for transferring heat therebetween;

a heat exchanger connected with said housing, having a first portion thereof in heat-transfer relation with the other of said thermoelectric element heat-transfer faces, and a second portion thereof communicating with ambient atmosphere for exchanging heat therewith;

a source of portable electric power mounted in said housing to provide a self-contained unit that can be hand-held and manually transported; said electrical power source being electrically connected with said thermoelectric element;

means for reversing the polarity of the electric power applied to said thermoelectric element, whereby said thermoelectric element can selectively heat or cool said housing cavity to maintain the receptacle of temperature-sensitive material therein at a desired temperature range; and a multiple-set-point temperature controller apparatus mounted on said housing, including means for sensing the temperature in said housing cavity; said temperature controller apparatus having portions electrically connected between said electric power and said thermoelectric element to control electric current flow therebetween, and thereby automatically maintain the temperature within said housing cavity at the desired temperature range by selective heating and/or cooling.

2. A temperature-controlled chamber as set forth in claim 1, wherein:

said polarity reversing means comprises electrical switching means associated with said temperature controller, such that the heating and cooling functions of said thermoelectric element are automatically actuated in response to sensed temperature conditions in said housing cavity.

3. A temperature-controlled chamber as set forth in claim 1, wherein:

said housing has a two-piece construction with first and second members which sealingly adjoin one another, and means for detachably connecting the first and second members together;

said first housing member having said thermoelectric element, said heat exchanger, said electric power source, said temperature controller, and said polarity reversing means mounted thereupon;

said second housing member having said receptacle-receiving cavity therein; and including:

an alternate housing member having a cavity shaped to receive a different size of receptacle therein, and including means for detachable connection with said first housing member to adpat said chamber for use with differently-sized receptacles.

4. A temperature-controlled chamber as set forth in claim 3, wherein:

said temperature-sensing means is mounted in said housing first member in a position disposed adjacent said cavity of the second member when the two such members are interconnected.

5. A temperature-controlled chamber as set forth in claim 4, including:

a second temperarture-sensing means mounted in said heat exchanger, and connected with said temperature-controller for interrupting electrical power supplied to said thermoelectric element when the temperature of said heat exchanger exceeds a predetermined limit.

6. A temperature-controlled chamber as set forth in claim 1, including:

a receptacle for connecting onto an outside source of electrical power, to provide power from said outside source to said temperature-controlled chamber; and a switch electrically connected between said thermoelectric element and each said power source for connecting said thermoelectric element with a selected one of said power sources.

7. A temperature-controlled chamber as set forth in claims 1 or 3 wherein:

said heat exchanger comprises a cylindrical member having fins positioned upon the exterior thereof, said heat exchanger comprising a radiator in a cavity-refrigeration mode and a heat absorber in a cavity-heating mode.

8. A temperature-controlled chamber as set forth in claim 7, including:

a heat sink connected with a base of said heat exchanger.

9. A temperature-controlled chamber as set forth in claim 8, wherein:

said heat sink is molded in said housing.

10. A temperature-controlled chamber as set forth in claim 1, including:

a conductive diaphragm mounted in an aperture communicating with said cavity; and means mounting said one heat transfer face in a position abutting said conductive diaphragm.

11. A temperature-controlled chamber as set forth in claim 10, including:

a heat sink connected to said heat exchanger for thermal transfer therebetween; and means supporting said other heat-transfer face in a position abutting said heat sink.

12. A temperature-controlled chamber as set forth in claim 11, wherein:

said one heat transfer face is fused to said diaphragm.

13. A temperature-controlled chamber as set forth in claim 12, wherein:

said diaphragm is in the nature of a leaf spring, and resiliently retains said other heat-transfer face of said thermoelectric element in abutment with said heat sink to define said supporting means.

* * * * *

UNITED STATES PATENT AND TRADEMARK OFFICE

CERTIFICATE OF CORRECTION

PATENT NO. : 4,407,133

DATED : October 4, 1983

INVENTOR(S) : Glenn V. Edmonson

It is certified that error appears in the above-identified patent and that said Letters Patent is hereby corrected as shown below:

Column 1, line 27:

"particualarly" should be --- particularly ---;

Column 5, line 14:

"-transferable" should be --- -transfer ---;

Column 7, line 14:

"plurality" should be --- polarity ---;

Column 8, Claim 3, line 55:

"adpat" should be --- adapt ---.

Signed and Sealed this

Twenty-second Day of May 1984

[SEAL]

Attest:

GERALD J. MOSSINGHOFF

Attesting Officer

Commissioner of Patents and Trademarks